United States Patent [19]

Langlitz et al.

[11] 4,268,014

[45] May 19, 1981

[54] TRANSPORT LIFT TRUCK FOR METALLURGICAL VESSELS, PARTICULARLY STEEL MILL CONVERTERS

[75] Inventors: Karlheinz Langlitz, Mülheim; Günter Schmitz, Duisburg, both of Fed. Rep. of Germany

[73] Assignee: Mannesmann Demag AG, Duisburg, Fed. Rep. of Germany

[21] Appl. No.: 111,088

[22] Filed: Jan. 10, 1980

[30] Foreign Application Priority Data

Jan. 29, 1979 [DE] Fed. Rep. of Germany ..... 2903361

[51] Int. Cl.[3] ..... B65G 7/00

[52] U.S. Cl. ..... 266/165; 414/590

[58] Field of Search ..... 266/143, 165; 414/589, 414/590

[56] References Cited

U.S. PATENT DOCUMENTS

| | | | |
|---|---|---|---|
| 3,718,265 | 2/1973 | Trost | 266/165 |
| 3,944,083 | 3/1976 | Fisher et al. | 266/165 |

FOREIGN PATENT DOCUMENTS

| | | | |
|---|---|---|---|
| 311399 | 11/1973 | Austria | 266/165 |
| 1141660 | 12/1962 | Fed. Rep. of Germany | 266/165 |
| 2008396 | 5/1976 | Fed. Rep. of Germany | 266/165 |
| 2725123 | 8/1978 | Fed. Rep. of Germany | 266/165 |

*Primary Examiner*—M. J. Andrews

*Attorney, Agent, or Firm*—Mandeville and Schweitzer

[57] ABSTRACT

A truck is provided for transporting and lifting heavy metallurgical vessels from one place to another. The truck combines two functions ordinarily provided by two different trucks, in that the truck of the invention lifts and/or removes the vessel from its tilting mount for relining and when replacing it on the mount also refits the bottom plate and cover onto the vessel, the latter function usually being carried out by a separate truck. The arrangement includes a separate bottom plate carrying device configured to be positioned on the truck. The carrying device is positioned to be non-displaceable on the lifting mechanism and to be, when thus placed, subject to the centering and lifting mechanisms of the truck of the invention.

7 Claims, 4 Drawing Figures

TRANSPORT LIFT TRUCK FOR METALLURGICAL VESSELS, PARTICULARLY STEEL MILL CONVERTERS

BACKGROUND AND STATEMENT OF THE INVENTION

The invention relates to a transport lift truck for metallurgical vessels, and particularly for steel mill converters. The truck of the invention has a lift platform with a circumference which accommodates several hoisting mechanisms on the truck frame. Also, flexibly attached pendulum rods are provided between the hoisting mechanisms and the hoisting platform.

Such lift trucks serve to transport the metallurgical vessel with worn lining which is to be replaced, to a lining station. After the new assembly, the truck returns it to the operating station. The exchange is effected, in view of the extremely heavy weight of the metallurgical vessels of several hundred tons, on horizontally installed rail tracks. Such a lift truck is also equipped with hoisting mechanisms in order to lift the metallurgical vessel from the level of the truck frame into the tipple or tilting device. The level of the tipples, in the metal treatment stations, and particularly in the steel mills, depends upon the level of the tapping vessels into which the liquid metal is tapped.

The dimensions of such tapping vessels are, in turn, determined by their capacity. Tapping vessels with a volume of up to 300 tons of steel and more are utilized. The size of the tapping vessels results in a lift of several meters for the metallurgical vessels weighing several hundred tons. In order to produce the necessary hoisting power, hoisting mechanisms are required which, distributed in sufficient number of the circumference of the hoisting platform, are able to generate the total lift power.

In metal treatment operations, such as foundries, desulfurization stands, and in steel mills, a multitude of other lift trucks are utilized besides the present kind of lift trucks, e.g. lift trucks for removable vessel parts, such as converter bottoms. Lift trucks for metallurgical vessels, or so-called converter exchange trucks, have been disclosed in German DE-PS 20 08 396; they consist essentially of a truck frame with several sets of wheels, and hoisting mechanisms arranged on the truck frame, which are connected to a hoisting platform. Also, a device has been disclosed in German DE-AS 11 41 660 with a vertical lift piston to join the converter bottom plate to a converter.

The present invention is based on the requirement of reducing the expenditure in lift trucks for metallurgical vessels. This is solved by the invention, using the lift truck mentioned initially, by providing a removable carrying device on the hoisting platform for a vessel bottom plate with the latter to be inserted in and/or removed from a metallurgical vessel. The concept of the invention thus leads directly to the combination of a lift truck as vessel exchange truck with a truck to insert the bottom plate. The invention, therefore, completely eliminates a separate truck to insert the bottom plate. Since the hoisting mechanisms of the lift truck are, without exception, dimensioned for the weight of the metallurgical vessel, it follows that the hoisting mechanisms can, without any problem, bear the weight of the various structural groups of metallurgical vessels. The combined lift truck/bottom-insert truck according to the invention incorporates a freedom of movement in the hoisting platform in any direction, so that a desired freedom of motion is given to insert the bottom portion of a vessel. Such freedom of motion is necessary to compensate for slight deviations from the structural form of metallurgical vessels which may warp during operation.

Preferably, the carrying device for the vessel bottom, according to another detail of the invention, is supported via supporting elements in recesses of the hoisting platform. The setting down of the carrying device by means of a crane into the recesses mentioned makes a further attachment of the carrying device to the hoisting platform superfluous.

In order to balance greater inaccuracies when inserting or placing vessel parts and/or vessel bottom parts which may, for example, also be caused by incorrect placement of the lift truck on the rail tracks, provision is made, furthermore, to arrange the carrying device with reference to the vessel bottom part on the hoisting platform on two crossed lines allowing for horizontal orientation and adjustment. Another adjustment feature of the invention which is useful during assembly and dismantling of entire metallurgical vessels, as well as during assembly or dismantling of vessel parts, such as vessel bottom parts, consists in providing the pendulum-seated hoisting platform with reference to the truck frame on two crossed lines allowing for horizontal orientation and adjustment. The adjusting motions may then be made in a reciprocating motion, if for each of the adjusting directions two thrust gears each are provided. In this case, the part to be moved, which may be either the hoisting platform or the carrying device, is advanced.

Additionally, in accordance herewith, the thrust gears each consist of hydraulically movable piston cylinder gears with piston rods which are each supported on vertical guides which are firmly attached to the truck frame. The vertical guides intercept here the horizontal supporting forces resulting from the thrust motion. Another improvement for the guidance of the thrust gears is achieved by attaching the guides on the casings of the hoisting mechanisms with the main axes thereof arranged vertically. Also, the friction between the vertical guides and the piston rods may be reduced by arranging rollers on the piston rods of the thrust gears, which are then supported on the vertical guides.

An exceedingly simple form of the carrying device of the invention is provided by having the carrying device for the vessel bottom part provided with a ring, with supporting cantilevered legs extending outward from the ring. Also, a ball and socket joint is provided in the center of the ring and connected to it, with the supporting plate for the vessel bottom part being joined to the latter.

An example of the invention is shown on the drawing and is explained as follows.

DETAILED DESCRIPTION OF THE INVENTION

Figure 1:
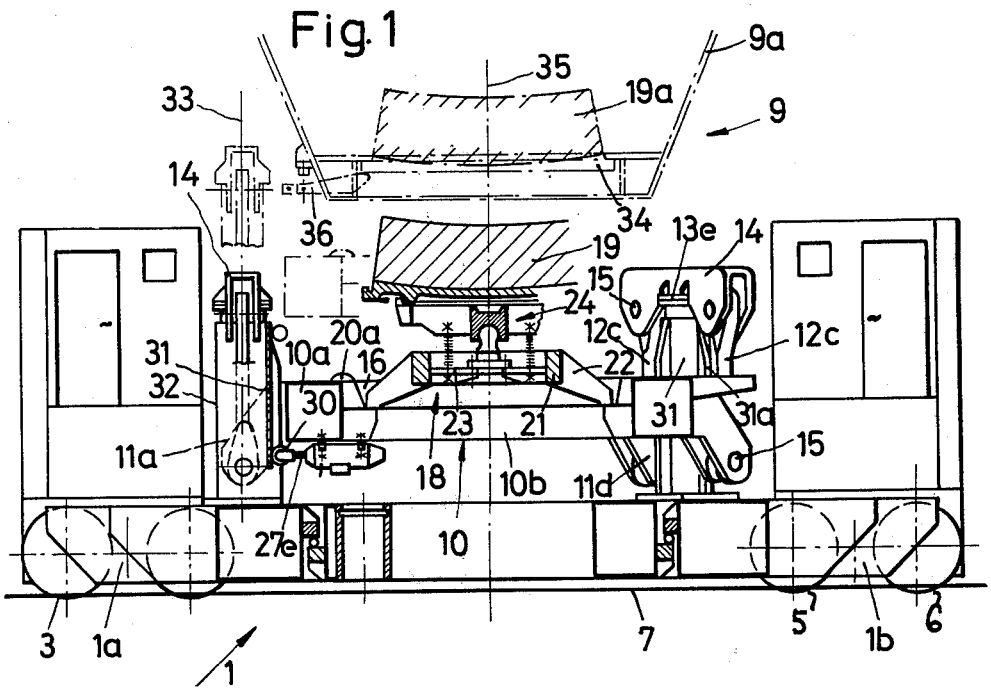
FIG. 1 is an elevational view of a lift truck illustrating the invention and operating as a bottom-insert truck with a metallurgical vessel positioned above.

The lift truck is equipped with a truck frame 1 whose frame parts 1*a* and 1*b* bear multiaxial wheel blocks 2*a*, 2*b*. The lift truck thus supported on the wheel pairs 3, 4, 5, and 6 travels on rails 7 and 8 underneath the stand of the metallurgical vessel which, in the example of FIG. 1 consists of a steel mill converter 9 whose bottom area 9*a* is partially shown. The hoisting platform 10 is located on the lift truck. The hoisting platform 10 is supported, on its brackets or forks 11*a*, 11*b*, 11*c* and 11*d* (FIG. 2) on pendulum rod pairs 12*a*, 12*b*, 12*c* and 12*d*. The pendulum rod pairs 12*a* through 12*d* are, at their respective lift heads 13*e*, provided with a ball and socket joint, not really shown, and are attached to the brackets 11*a* through ll*d* and at the yoke 14 by means of pivot joints 15. Each hoisting mechanism 13*a*, 13*b*, 13*c* and 13*d* is equipped with such a lift head 13*e*.

The hoisting platform is shaped as a hollow ring 10*a*, the brackets 11*a* through 11*d* being attached to it. In the interior of the hollow ring 10*a*, an annular offset 10*b* is provided so that there is a recess 16 in the upper marginal area or boundary. The recess 10*b* thus formed accommodates around the circumference, slide faces 17*a*, 17*b*, and 17*c*, which are firmly attached to the hoisting platform at intervals of 120°, and which serve to guide the carrying device 18 for the vessel bottom part 19. Cupola-shaped support prominences 20*a*, 20*b*, and 20*c* are firmly affixed to the hoisting platform 10 for the support of the metallurgical vessel 9 which is to be lifted into its tilting mount.

Figure 3:
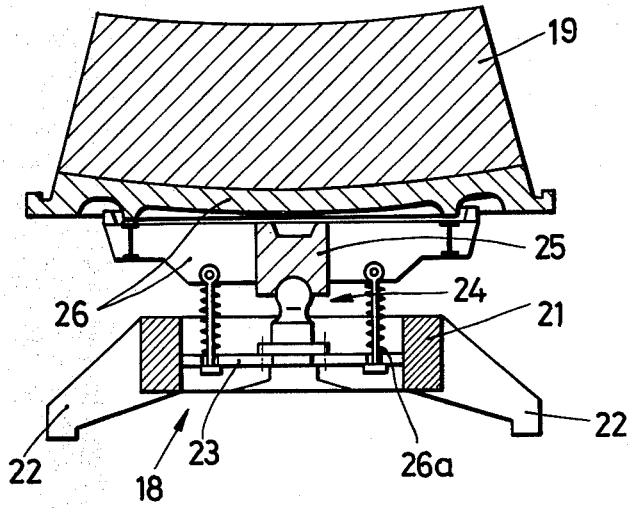
FIG. 3 is an enlarged vertical axial sectional view through the carrying device of the invention.
Figure 4:
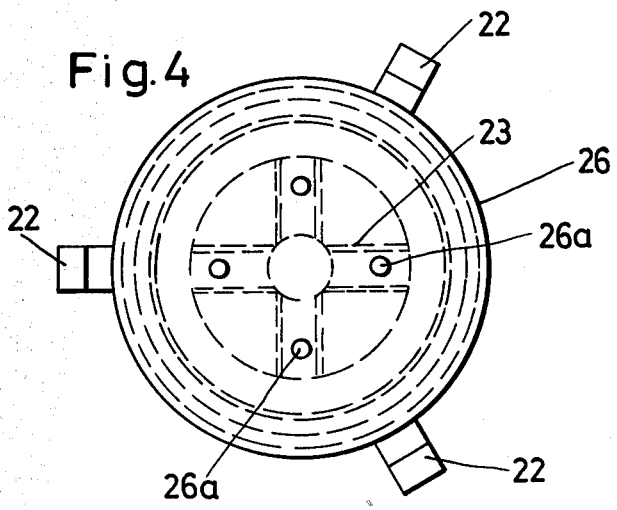
FIG. 4 is the ground plan of the carrying device of FIG. 3.

The carrying device 18 consists, in its main components, of a ring 21, to which are joined, according to the example given, support cantilevered legs 22 around the circumference, spaced 120° from each other. Within the ring 21, several braces 23 (FIGS. 1, 3 and 4) extend to the centrally arranged ball and socket joint 24, whose joint socket 25 is connected to a supporting plate 26 which receives the vessel bottom part 19. The supporting plate 26 rests on spring bundles 26*a*, each supported on a stay 23, and can therefore tilt by a predetermined angle to one side only.

The carrying device thus formed and indicated in its entirety by 18 rests, without displacement, on the hoisting platform 10. Thrust gears 27*a*, 27*b*, 27*c* and 27*d* (FIG. 2) consisting of piston cylinder gears are seated on the hoisting platform 10. The thrust gears 27*a* and 27*c* work in pairs on one common orienting line 28. In opposite directions, also the thrust gears 27*b* and 27*d* work on the common orienting line 29, also in opposite directions to each other. Rollers 30 rest on the piston rods 27*e*, rolling along the perpendicular guides 31 under the power of the piston rod 27*e*. In the example (FIG. 1) the guides 31, provided with lateral walls 31*a*, rest on the casings 32 of the hoisting mechanisms 13*a* through 13*d* attached to the truck frame 1, with their main axis 33 running vertically.

Figure 2:
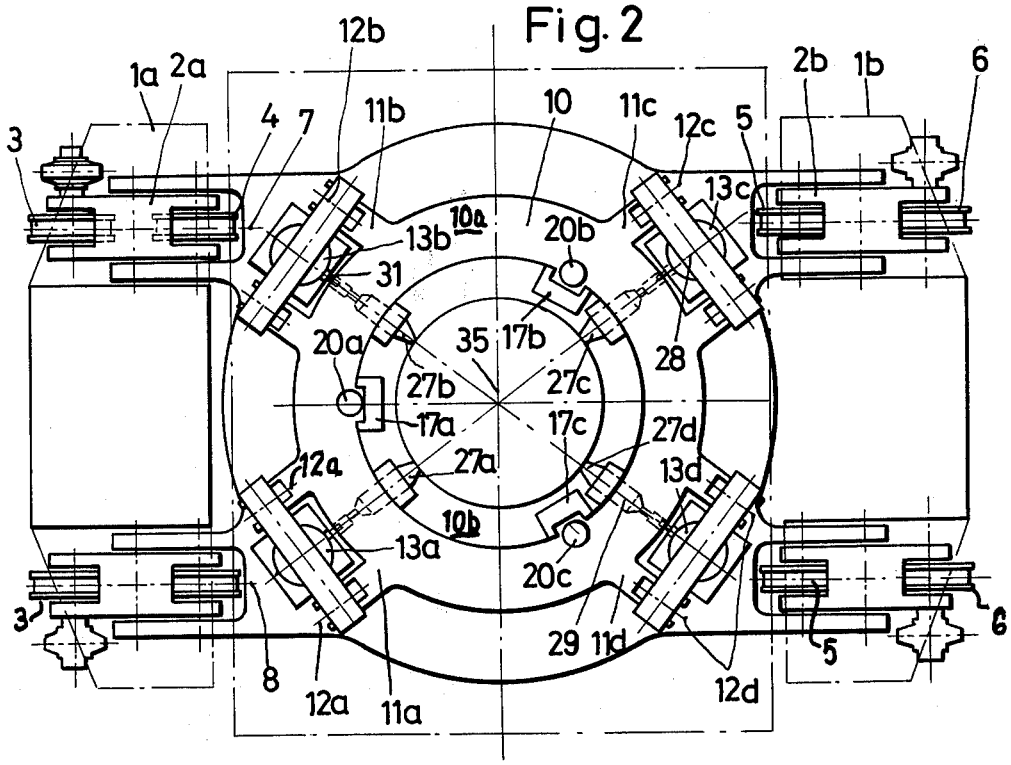
FIG. 2 is a top plan view of the lift truck of FIG. 1, in which the carrying device of the invention is not shown.

The insertion of the vessel bottom part 19 which was brought into the position according to FIG. 1 by means of the lift truck, takes place as follows: the hoisting platform 10 lifts during synchronous operation of the hoisting mechanisms 13*a* through 13*d* parallel to the horizontal level into the position as shown in dot-dash lines in FIG. 1, left half. Just before reaching this lift position a check is made whether the lining part 19*a* of the vessel bottom part 19 may be inserted smoothly into the bottom opening of the metallurgical vessel and whether the cover plate 34 of the vessel bottom part 19 rests against the vessel bottom with its annular circumference. If a position occurs which is not in line with the main vessel axis 35, the thrust gears 27*a*/27*c* and/or 27*b*/27*d* are moved, depending upon the existing deviation, in opposite directions with reference to each pair, until the most favorable position of insertion has been achieved, so that the vessel bottom plate 19*a* may be moved into the operating position shown in dot-dash lines.

Before lowering the hoisting platform 10 the cover plate 34 is attached to the metallurgical vessel 9. To this end, levers 36 which are not shown in detail but merely indicated in dot-dash lines, are provided which lock the plate.

The placement of the complete metallurgical vessel 9 is done in similar fashion. This can be accomplished with or without the feed mechanisms moving the hoisting platform 10 back and forth along the orienting lines 28 and/or 29. If the principle of the thrust gear pairs 27*a* through 27*d* is to be transferred to the hoisting platform 10 for complete metallurgical vessels as well, the hoisting mechanisms 13*a* through 13*d* may be placed together onto a sliding stage (not shown) which may then be displaced in at least two crossing directions by means of a doubly chargeable hydraulic piston cylinder gear or by means of pairs of singly chargeable piston cylinder gears, and which rests on the truck frame 1. On account of the hoisting mechanisms 13*a* through 13*d* and the pendulum rod pairs 12*a* through 12*d*, an automatic adjustment of two surfaces takes place which, in the practical application, are not completely parallel and whose full contact is to be accomplished.

I claim:

1. A combination metallurgical vessel lift truck and metallurgical vessel parts carrying device comprising (a) a truck frame;

(b) a hoisting platform movably secured to said frame;

(c) a plurality of hoisting means for selectively elevating said hoisting platform, said hoisting means being circumferentially spaced around said frame;

(d) pivotally attached pendulum rods extending between each said hoisting means and said hoisting platform; and (e) a removable carrying device for metallurgical vessel parts, positionable on said hoisting platform centrally of said spaced hoisting means.

2. The apparatus of claim 1, further characterized by (a) adjusting means secured to said hoisting platform and said truck frame for providing relative horizontal adjustment of said hoisting platform along perpendicularly extending common orienting lines.

3. The apparatus of claim 2, further characterized by (a) said adjusting means includes a pair of oppositely acting thrust gears on each of said perpendicularly extending common orienting lines.

4. The apparatus of claim 3, further characterized by (a) each said thrust gear is a pressure, fluid-activated piston cylinder gear; and (b) a vertical guide on said frame for engaging rollers of each of said piston cylinder gears, each of said rollers being secured to the piston rods of the piston cylinder gears.

5. The apparatus of claim 4, further characterized by (a) each of said vertical guides is attached and corresponds to one of said hoisting means.

6. The apparatus of claim 1, further characterized by (a) a plurality of circumferentially spaced supporting legs on said carrying device; and (b) a plurality of cooperating recesses on said hoisting platform for receiving said supporting legs.

7. The apparatus of claim 6, further characterized by said parts carrying device comprising:

(a) a ring shaped body;

(b) said circumferentially spaced supporting legs cantilevered from said ring shaped body;

(c) a ball and socket joint supported centrally of said ring shaped body; and (d) a metallurgical vessel parts-receiving carrying plate positioned on said ball and socket joint.

* * * * *